United States Patent [19]

Baron

[11] Patent Number: 4,592,417

[45] Date of Patent: Jun. 3, 1986

[54] HEAT EXCHANGER TUBE CLEANING ELEMENT CAPTURING DEVICE WITH OFFSET STOP

[75] Inventor: Walter J. Baron, Mequon, Wis.

[73] Assignee: Water Services of America, Inc., Milwaukee, Wis.

[21] Appl. No.: 678,352

[22] Filed: Dec. 5, 1984

[51] Int. Cl.[4] ..... F28G 1/12

[52] U.S. Cl. ..... 165/95; 15/3.51

[58] Field of Search ..... 165/95; 15/3.5, 3.51

[56] References Cited

U.S. PATENT DOCUMENTS

| | | | |
|---|---|---|---|
| 3,319,710 | 5/1967 | Heeren et al. | 165/95 |
| 3,973,592 | 8/1976 | Cleaver et al. | 137/625.43 |
| 4,124,065 | 11/1978 | Leitner et al. | 165/95 |
| 4,382,465 | 5/1983 | Baron et al. | 165/95 |

*Primary Examiner*—Sheldon J. Richter

*Attorney, Agent, or Firm*—Andrus, Sceales, Starke & Sawall

[57] ABSTRACT

A heat exchanger (1) has a plurality of fluid flow tubes (5) secured adjacent their ends by tube sheets (6, 7). Cleaning elements (18) are adapted to shuttle back and forth in the tubes and are adapted to be captured by elongated slotted baskets (17). A cleaning element retaining device includes inwardly extending pairs of projections (30, 31) integral with the basket and with the respective pairs being offset longitudinally along the basket axis. A cleaning element can be tiltingly manipulated past the pairs of projections for insertion or removal into or out of the basket without substantial damage to the projections.

7 Claims, 8 Drawing Figures

HEAT EXCHANGER TUBE CLEANING ELEMENT CAPTURING DEVICE WITH OFFSET STOP

U.S. PRIOR ART OF INTEREST

| U.S. Pat. No. | Inventor | Issue Date |
|---|---|---|
| 3,319,710 | Heeren et al | May 16, 1967 |
| 3,973,592 | Cleaver et al | August 10, 1976 |
| 4,124,065 | Leitner et al | November 7, 1978 |

BACKGROUND AND SUMMARY OF THE INVENTION

This invention relates to an improved heat exchanger tube cleaning element capturing device.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttleable cleaning elements such as brushes. Fluid flowing in one direction through the tubes keeps the cleaning elements captured within their respective basket chambers, while the fluid discharges outwardly through openings in the basket walls. Upon reversal of fluid flow, the cleaning elements are forced out of their baskets and through the tubes to the baskets at the opposite tube ends to thereby perform a tube cleaning action.

Many baskets are designed of slightly flexible plastic and with their elongated body portions formed by alternating ribs and fluid flow-through slots which terminate in an annular outer end ring. The inner edge portion of the ring is alternately joined to the ribs or exposed to form the outer slot ends. For purposes of retaining a cleaning element within the basket and yet allowing the cleaning element to be inserted or removed for more complete access to the tube interiors, a plurality of circumferentially spaced chordally inwardly extending nib-like projections have been integrally mounted to the outer end of the basket Heretofore the projections have been disposed in a single plane. See U.S. Pat. No. 3,973,592.

Many cleaning elements have comprised elongated tube scrubbing devices, such as brushes, having conical end caps. When inserting such a cleaning element into a basket through the aforementioned projections, it has been found that at least one of the end caps had to be forced past the projections, causing the latter to bend and sometimes break off. Removal of the cleaning element from the basket has been subject to similar problems. Furthermore, in the event a projection weakens or breaks, the cleaning element may escape from the basket altogether.

It is a task of the present invention to provide a projection-type cleaning element retaining means on the outer end of the basket which is constructed to permit insertion and removal of the cleaning element without bending or breaking of the projections, and while effectively reduces the opportunity for the cleaning element to escape from the basket during outward fluid flow therethrough.

In accordance with the various aspects of the invention, the cleaning element retaining means comprises opposed longitudinally offset projections which are disposed in axially spaced planes. In the embodiment disclosed herein, each plane contains a pair of circumferentially spaced projections. The longitudinal offset is such that a space is provided through which the concial end caps of the cleaning element may be "threaded" or manipulated by tipping the cleaning element at an angle to the basket axis and then pushing or pulling the cleaning element through.

Once the cleaning element is positioned within the basket, the longitudinally innermost projections act as a stop. During fluid flow outwardly through the basket, if for any reason the innermost projections fail to function and the cleaning element starts to move axially outwardly, the longitudinally outermost projections will function as a supplemental stop.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
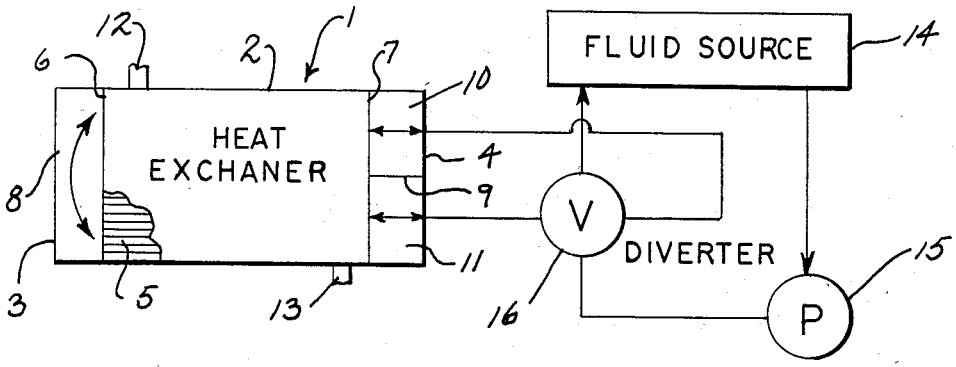
FIG. 1 is a schematic showing of a heat exchanger and fluid flow controls therefor.

The present invention is directed to tube-type heat exhangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, and as best shown in FIG. 2, a plurality of assemblies are disposed in chambers 8, 10 and 11 and include longitudinally extending elongated baskets 17 which are mounted to tube sheets 6 and 7 so that they are in fluid communication with the interiors of tubes 5.

Baskets 17 are adapted to capture and hold a shuttling cleaning element, such as a brush 18, which moves back and forth between a basket pair through the respective tube 5, depending upon the setting of valve 16. FIG. 2 illustrates one brush 18 disposed in one end basket 17. In the embodiment shown, brush 18 generally comprises a stem 19 holding an elongated spiral array of brush bristles 20 and conical end caps 21 and 22.

Basket 17 has a central body portion comprising a plurality of alternate fluid flow slots 23 and ribs 24 which terminate at their outer ends in an annular ring 25 forming the outer end portion of the basket.

Figure 2:
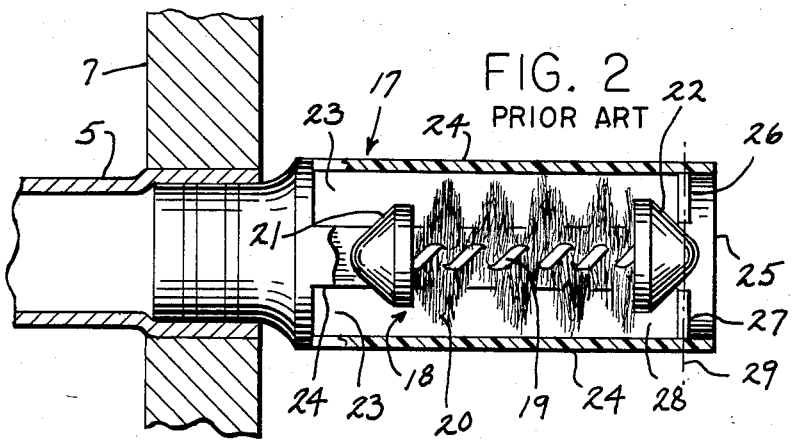
FIG. 2 PRIOR ART
FIG. 2 is a longitudinal section showing a cleaning element captured within a basket as heretofore constructed.
Figure 3:
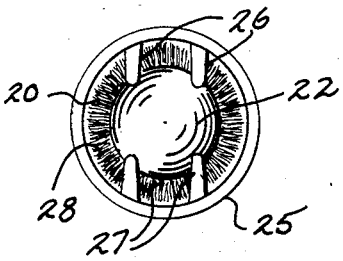
FIG. 3 PRIOR ART
FIG. 3 is an end view of the known assembly of FIG. 2.

In the known device shown in FIGS. 2 and 3, the outer end portion of basket 17 is provided with a brush retaining means through which brush 18 may be inserted into or removed from the basket. The retaining means comprises a plurality of projections 26, 27 which are integral with ring 25 and extend chordally inwardly into the brush chamber 27. As shown, there are four projections which are circumferentially spaced and which are arranged in pairs with the upper pairs of projections 26 being disposed in generally diametrically opposed facing relationship to the lower pair of projections 27. The pairs of opposing projections terminate closer together than the diameter of conical brush end caps 21 and 22, with projections 26, 27 all being in a single transverse plane 29.

As previously described, to insert brush 18 into basket 17 from the outer open brush end, it is necessary to push the brush end caps inwardly past projections 26 and 27, with the result that the projections are bent or deformed, which may cause one or more projections to break off. The brush retaining function may therefore be lost when fluid flows outwardly through basket 17.

The aspects of the present invention essentially solve the aforementioned problem.

Figure 7:
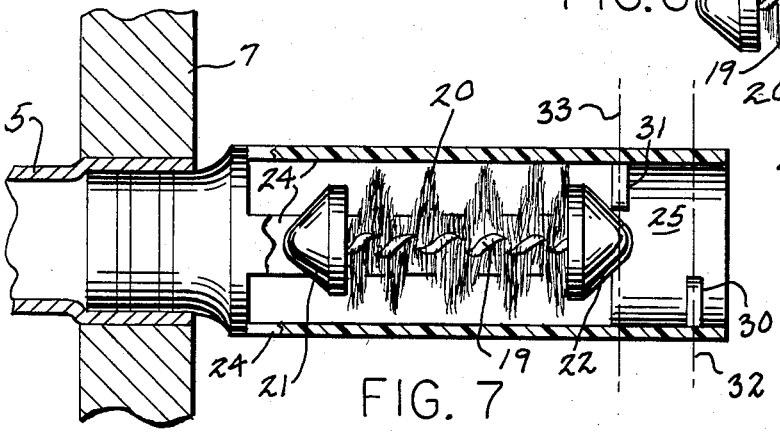
Figure 8:
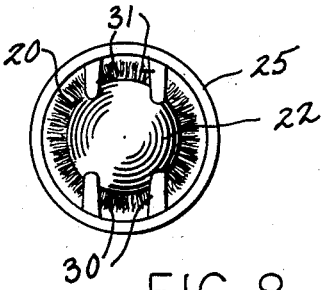
FIG. 8 is an end view of the assembly of FIG. 7.

The improved device shown in FIGS. 4–8 is generally similar to that of FIGS. 2–3 with similar reference numerals applied, with the exception of the brush retaining means. In this instance, the retaining means comprises chordally inwardly extending projections 30, 31 which are longitudinally offset along the central brush axis and disposed in axially spaced planes 32 and 33 respectfully. In the embodiment shown, there is a pair of circumferentially spaced outer projections 30 which are integral with a forward portion of ring 25; and a pair of circumferentially spaced inner projections 33 which are integral with a rearward or inner portion of the ring. In end elevation, as shown in FIG. 8, the pairs of projections are disposed in generally opposed relation.

Figure 4:
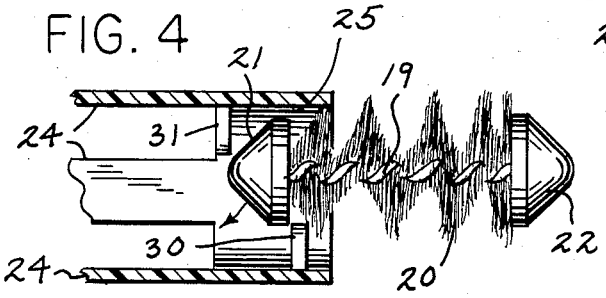
FIGS. 4–7 are fragmentary longitudinal sections of the device constructed in accordance with the aspects of the present invention and illustrating the method of assembling the cleaning element into the basket.
Figure 5:
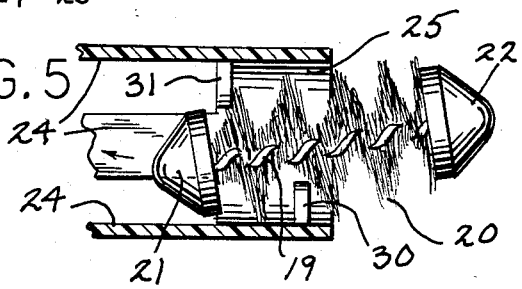
Figure 6:
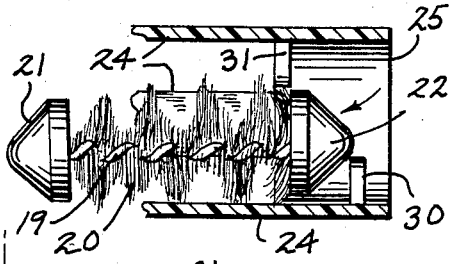

To insert a brush 18 into basket 17, the brush is inserted into the basket so that leading cap 21 by-passes outer projections 30, as in FIG. 4. Brush 18 is then tilted, as in FIG. 5, so that leading cap 21 is "threaded" downwardly past inner projections 31. Continued manipulation of the brush will cause trailing end cap 22 to bypass outer probjections 30, as in FIG. 6, with some of the brush bristles 20 being deformed against the basket wall. Cap 22 will ultimately pass inwardly by projections 31 and the brush will finally take the position shown in FIG. 7. During the insertion, end caps 21 and 22 do not forcingly engage projections 30 and 31 so as to substantially bend or break the latter. Removal of the brush can be accomplished by reversing the above procedure.

When brush 18 is in its final position shown in FIG. 7, inner projections 31 function as primary stop means to hold the brush in place during outward fluid flow through basket 17. If, for some reason, inner projections 31 are in damaged or weakened condition such as caused during basket installation, the pressure of outward fluid flow might conceivably cause cap 22 to break one or more projections 31 off. Brush 18 might then tend to move outwardly and might escape from basket 17, were it not for outer projections 30 which function as a secondary stop means to prevent brush escape.

The concepts of the invention provide a simple yet effective improvement over the prior known devices of this type.

Various modes of carrying out the invention are contemplated as being within the scope of the following claims particularly pointing out and distinctly claiming the subject matter which is regarded as the invention.

I claim:

1. For use in a heat exchanger or the like having a housing containing a plurality of fluid flow tubes, a device comprising:

(a) a longitudinally extending elongated basket having an open outer end and with said basket adapted to capture a tube cleaning element propelled through a tube by fluid, (b) and cleaning element retainer means integral with and disposed adjacent the said open outer end of said basket therewithin for preventing outward escape of a cleaning element from the basket during outward fluid flow through said basket, (c) said retainer means being adapted for insertion and removal of a cleaning element therethrough and comprising: longitudinally offset inner and outer projection means disposed in axially spaced generally transverse inner and outer planes and with said projection means being positioned so that a cleaning element can be manipulated therepast without substantially distorting said projection means.

2. The device of claim 1 wherein said inner projection means comprises stop means for retaining the cleaning element within said basket.

3. The device of claim 1 wherein said inner and outer projection means comprise primary and secondary stop means, respectively, for retaining the cleaning element within said basket.

4. The device of claim 1 wherein each of said inner and outer projection means comprises a plurality of circumferentially spaced projections with the projections of said inner and outer projection means being, in end view, in generally opposed relationship.

5. The device of claim 4 wherein said projections extend generally chordally into said basket.

6. The device of claim 4 wherein:

(a) said basket includes a central body portion comprising a plurality of alternate fluid flow slots and ribs which terminate at their outer ends in an annular ring, (b) said projections of said outer projection means extending from the outer portion of said annular ring, (c) and said projections of said inner projection means extending from the inner portion of said ring.

7. The device of claim 4 wherein said inner and outer projection means comprise primary and secondary stop means, respectively, for retaining the cleaning element within said basket.

* * * * *